US005954525A

United States Patent [19]

Siegal et al.

[11] Patent Number: 5,954,525

[45] Date of Patent: Sep. 21, 1999

[54] EXTENDABLE TEMPORARY ELECTRICAL RECEPTACLE

[75] Inventors: Burton L. Siegal, Skokie, Ill.; David R. Gutgsell; Scott Schwinghammer, both of Jasper, Ind.

[73] Assignee: Ditto Sales, Inc., Jasper, Ind.

[21] Appl. No.: 09/056,414

[22] Filed: Apr. 7, 1998

[51] Int. Cl.[6] ..... H01R 13/44

[52] U.S. Cl. ..... 439/131; 312/223.6

[58] Field of Search ..... 439/131; 174/48, 174/58; 220/3.7; 312/223.6

[56] References Cited

U.S. PATENT DOCUMENTS

| | | | |
|---|---|---|---|
| 3,433,886 | 3/1969 | Myers . | |
| 3,622,684 | 11/1971 | Press . | |
| 3,646,244 | 2/1972 | Cole . | |
| 3,794,956 | 2/1974 | Dubreuil . | |
| 4,511,198 | 4/1985 | Mitchell et al. . | |
| 4,551,577 | 11/1985 | Byrne . | |
| 4,747,788 | 5/1988 | Byrne . | |
| 4,792,881 | 12/1988 | Wilson et al. . | |
| 4,828,513 | 5/1989 | Morrison et al. . | |
| 5,023,396 | 6/1991 | Bartee et al. | 174/48 |
| 5,230,552 | 7/1993 | Schipper et al. . | |
| 5,351,173 | 9/1994 | Byrne . | |

*Primary Examiner*—Neil Abrams
*Assistant Examiner*—J. F. Duverne
*Attorney, Agent, or Firm*—Beck, Michael & Beck, P.C.

[57] ABSTRACT

An extendable/retractable temporary electrical receptacle assembly 10 is provided for mounting within an opening formed in the work surface S of an article of furniture, such as a table T. The receptacle assembly 10 includes a bezel 11 that is mounted by use of resilient locking tabs within the opening and a hollow receptacle formed from an upper portion 12 joined to a lower portion 3. The upper portion 12 carries an array of electrical/data sockets 21, 22 that are accessible above the work surface S when the receptacle assembly 10 is in an extended position. In a retracted position, the upper portion 12 is wholly contained within the bezel 11 to hide the array of sockets 21, 22. A pair of compression springs 55 is disposed within spring channels 52, 53 formed in the upper and lower portions of the receptacle. The springs 55 are bottomed on tabs 38 projecting inwardly from the bezel 11 and into the spring channels 52 in the receptacle. The bezel 11 also includes four evenly disposed inwardly projecting tabs 36 that are contacted by the receptacle at the retracted position to prevent over-depression of the assembly 10. The receptacle is provided with strain relief members 70 disposed in the cord openings in the lower portion 13 of the receptacle and engaged about cords providing power/signals to the sockets 21, 22 carried by the receptacle. The strain relief members 70 include outwardly projecting flaps 80 that contact the lower rim 37 of the bezel 11 to limit the upward travel of the receptacle in its extended position.

18 Claims, 6 Drawing Sheets

EXTENDABLE TEMPORARY ELECTRICAL RECEPTACLE

BACKGROUND OF THE INVENTION

The present invention relates to receptacles for providing electrical power and/or data connections to an existing article of furniture. Most particularly, the invention concerns an extendable and retractable receptacle assembly for mounting in the top of a table, desk or like article of furniture.

For many years, articles of furniture, such as desks and tables, have been provided with openings that allow a user to pass an electrical power cord through the top of the furniture. Such an arrangement has been very useful in managing the power cords associated with various electrical appliances, such as lamps, calculators and the like. Many desks and tables are provided with "knockouts" that can be removed to expose an opening in the tabletop through which the electrical cables can be extended.

As businesses have become more computer literate, the personal computer and all of its auxiliary hardware, are very prevalent. For example, many business training facilities rely upon the use of computers to help train their employees. In a typical setup, several computer stations can be provided at a single table or at multiple connected tables. In some cases, these computers are networked to one another. Similarly, many conference facilities provide meeting locations with computer networking and electronic data transmission capabilities. Again, the conference table becomes the site of a myriad of computer equipment and associated cabling.

In situations such as these, the task of managing the various electrical cables and data wires can become very significant. One solution, of course, is to simply drape the cables and wires over an edge of the table or desk work surface. Another solution is in the form of the knockout plates described above. However, it has been found that neither of these two solutions is very optimal and actually do very little to manage the large number of wires associated with a typical conference or training facility.

In a more optimal solution, the various wires and cables are carried along trackways that are mounted to the furniture. For example, in the case of a training or conference table, a conduit or trackway is attached to the underside or backside of the table top so that the various cables and wires can be collected and hidden. The use of these conduits or trackways has greatly alleviated the troublesome snarl of wires that may dangle from a single workstation.

While the use of these trackways has alleviated some of the nuisances associated with electrical/data wiring, the problem still remains as to the manner in which the electrical components are connected to the wires. In a typical conference or training facility, the worktables can be multifunctional. In other words, the tables do not always need to be "electrified" since computer equipment and other electronic equipment may not always be in use. In this instance, it is important to provide a table or desk that can take advantage of the various wire management features when electrical equipment is being used, while still being able to retain the useable tabletop space when electrical equipment is not being used.

Various solutions to this problem have been suggested throughout the years. For example, U.S. Pat. No. 4,828,513 shows a removable electrical housing assembly. In this particular assembly a plate is normally disposed over an opening in the furniture work surface. The plate can be removed and replaced by an electrical housing that is supported on the work surface. The electrical housing can be engaged to an electrical connector, which itself provides the various receptacle modules for use at the table. In another approach shown in U.S. Pat. No. 4,792,881, an array of electrical receptacles is fixed to the underside of a tabletop. A hinged lid can be closed over the electrical receptacles to form a flush surface with the work surface of the table. When it is desired to use the electrical receptacles, the lid is pivoted upward, thereby exposing the receptacles below the surface of the table.

In still another approach, the electrical receptacle itself is manipulated from a position below the work surface of the table or desk to a position exposed above the work surface. For example, in U.S. Pat. Nos. 4,747,788 and 5,230,552, an electrical receptacle assembly is pivoted to a position in which the receptacle sockets are available for use. In this case, the back of the receptacle is essentially flush with the work surface when the receptacle is in its retracted position. In another approach, exemplified in U.S. Pat. No. 5,355,173, the power receptacles are translated vertically through an opening in the table.

While each of these prior systems has helped address the problems of wire management in a powered work surface, they all suffer from various detriments. For example, the extendable/retractable receptacles of the prior art require fairly substantial structure and mechanisms to perform their appointed function. In systems such as represented by the hard mounted module in the '881 patent, the user is not left with the option to easily remove the power receptacle on demand. On the other hand, the completely removable assembly shown in the '513 patent requires the user to completely remove the electrical receptacle assembly when it is not in use.

Consequently, there remains a need for an extendable/retractable receptacle that is more versatile and easier to use than the various prior systems. Moreover, there is a need for such an apparatus that can be readily used with stowable furniture, such as folding tables. The large and bulky structure and mechanisms associated with the various retractable receptacles of the prior art do not lend themselves to use with such folding furniture.

SUMMARY OF THE INVENTION

To address this existing need, the present invention provides an extendable/retractable temporary electrical/data receptacle assembly for removable mounting within an opening formed through a work surface of an article of furniture. In preferred embodiments, the assembly includes a bezel that is held in place within the opening in the furniture work surface by a plurality of resilient fingers carrying locking tabs that engage the underside of the work surface. The bezel defines an annular wall projecting through the opening and below the work surface and defining a channel to guide the extension and retraction of the receptacle mounted within.

The assembly includes an electrical and/or data receptacle having a hollow body configured for slidable movement within the bezel. The receptacle includes an upper portion having an array of electrical and/or data sockets supported thereon for access above the work surface when the receptacle is in an extended position, and a lower portion defining at least one cord opening for receiving an electrical cord for electrical connection to the socket array. The hollow body of the receptacle provides ample space for the cords and wires necessary to make electrical connection between the sockets accessible to the user and the cord sets mating with the cord openings in the lower portion of the receptacle. The data sockets can be mounted on a removable plate, which has data cable, access through openings in the hollow body of the receptacle.

The assembly further includes an extension mechanism operable to store potential energy when the receptacle is held in the retracted position by a latch mechanism engaging the bezel. In the preferred embodiment, this extension mechanism, or means for storing potential energy, comprises at least two springs that are maintained in a compressed state when the receptacle is retracted. When the receptacle latch mechanism is released, the springs extend to move the receptacle to the extended position.

In one aspect of the invention, the springs are wholly contained within the receptacle upper and lower portions. The two portions define contiguous spring channels that encircle the springs and keep them safe from outside contact or interference. The springs contact the end of the channels at a closed upper portion and at a retaining ledge in the bottom portion to retain the springs in a partially compressed position. Moreover, the spring channels are configured to accomplish a further feature of the invention in which the bezel includes spring supports on which the springs are mounted. These spring supports are disposed within the spring channels to further compress the springs as the receptacle is moved from its extended position to its retracted position. In this aspect of the invention, the springs are held between the receptacle at their upper ends and the bezel at their lower ends.

In another feature of the invention, the bezel includes inwardly projecting tabs disposed at a plurality of locations around the lower perimeter of annular wall. The lower portion of the receptacle carrying the cord openings is sized to pass between these tabs as the receptacle moves between the extended and retracted positions. In the preferred embodiment, the mounting interface between the upper and lower portions of the receptacle form an enlarged flange that is sized to contact the tabs projecting inside the bezel. With this feature, the bezel provides a stop for the downward travel of the receptacle. Preferably, these tabs are fail-safe features since the receptacle and bezel are provided with a latch mechanism that should be engaged before the receptacle bottoms on the inwardly projecting tabs.

In still another aspect of the invention, a strain relief member is provided that is engageable about the electrical cord passing through the cord openings in the lower portion of the receptacle. The strain relief member is configured and sized for engagement within the cord opening in a known manner to provide strain relief in the event that the cord set is subject to an excessive pulling force. According to the invention, the strain relief member includes a flap that projects outward away from the lower portion when the member is engaged within the cord opening. The flap extends outward a sufficient distance to contact the lower rim of the bezel when the receptacle is in the extended position to thereby limit the upward travel of the receptacle within the bezel. The same flap can be formed on a blank end that is engaged in a cord opening when no cord set is disposed within the opening. The flap is configured to be flexed upward and inward to clear the lower rim of the bezel, to facilitate removal of the receptacle from the bezel.

It is one object of the present invention to provide an extendable/retractable receptacle assembly that can be readily and completely removed from an article of furniture. A further object is accomplished by aspects of the invention that completely conceal the extension mechanism, namely springs, from outside interference.

One benefit of the present inventive receptacle assembly is that the active components are protected by features associated with the fixed bezel. A further benefit resides in features of the bezel that automatically engage the compression springs supported within the receptacle, when the receptacle is pressed into the bezel. Moreover, the bezel operates as a limit stop to prevent over-extension of the receptacle and excessive depression into the bezel.

Other objects and benefits of the present invention can be ascertained from the following written description with reference to the accompanying figures.

DESCRIPTION OF THE PREFERRED EMBODIMENT

Figure 1:
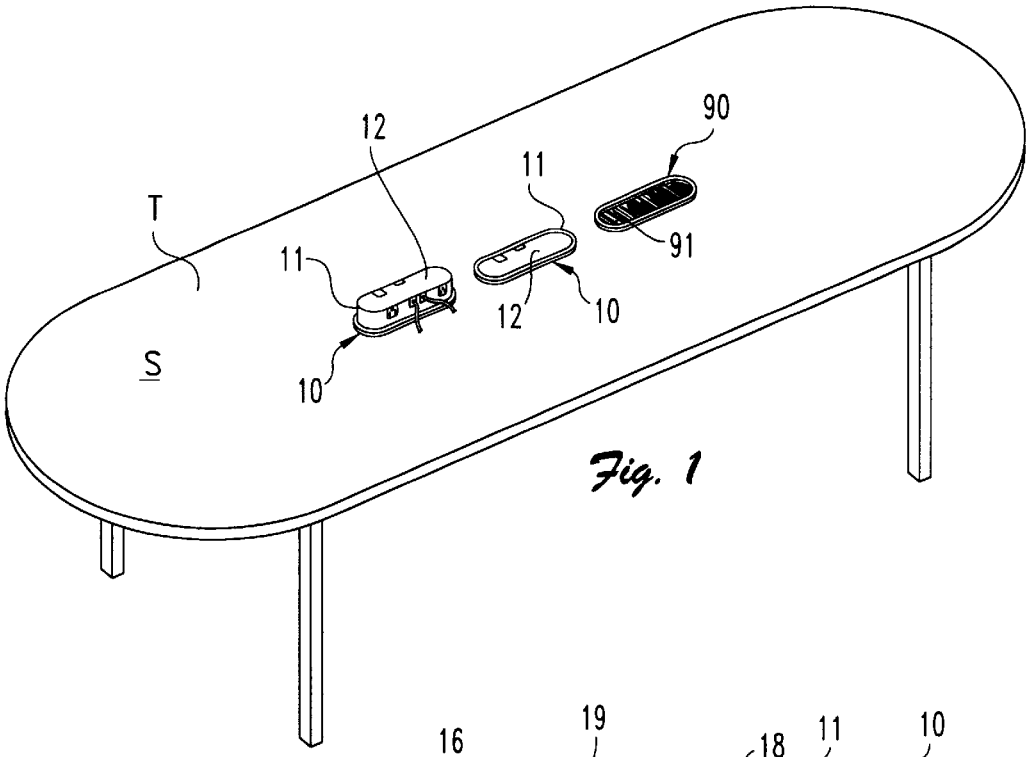
FIG. 1 is a top perspective view of a worktable incorporating an extendable electrical receptacle and a brush plate according to embodiments of the present invention.

For the purposes of promoting an understanding of the principles of the invention, reference will now be made to one preferred embodiment illustrated in the drawings and specific language will be used to describe the same. It will nevertheless be understood that no limitation of the scope of the invention is thereby intended, such alterations and further modifications in the illustrated embodiment, and such further applications of the principles of the invention as illustrated therein being contemplated as would normally occur to one skilled in the art to which the invention relates.

The present invention contemplates an extendable/retractable electrical receptacle that can be mounted within an article of furniture, such as table T shown in FIG. 1. The table T has a work surface S within which is mounted a pair of extendable receptacles 10 and a brush plate 90. Each of the receptacles includes a bezel 11 that is pressed into a corresponding opening formed or routed into the table surface S. Preferably, the bezel provides a smooth transition from the table surface S to the extendable receptacle assembly 10. Likewise, the brush plate 90 includes a bezel 91 that provides a similar smooth transition. The extendable receptacle. includes an upper housing 12, the top surface of which is exposed within the bezel 11. Preferably, the upper housing 12 and the bezel 11 provide an aesthetically pleasing appearance, which may in some cases be generally camouflaged relative to the table surface S.

Figure 2:
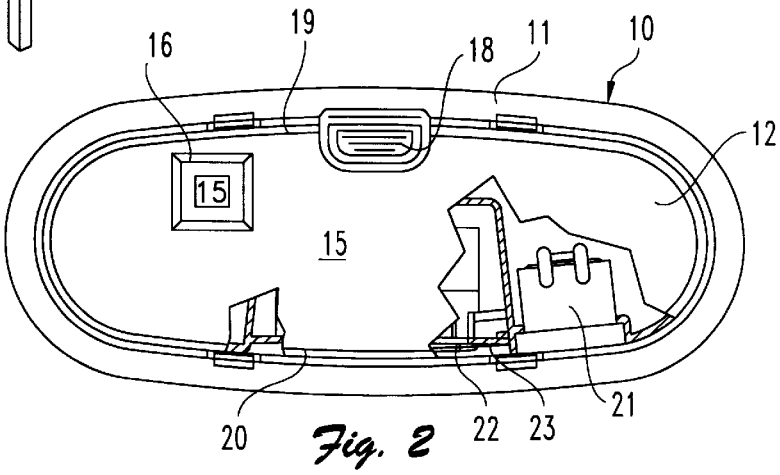
FIG. 2 is a top perspective view of an extendable electrical receptacle according to one embodiment of the present invention, with the receptacle shown in its retracted position.

Referring to FIG. 2, the extendable receptacle assembly 10 is depicted with the bezel 11 and the top surface of the upper housing 12 being shown. The upper housing 12 includes an upper plate 15 that is exposed at the table surface S in one embodiment. The upper plate 15 can include a power indicator 16, which can provide an illuminated indication to the user that electrical power is being supplied to the receptacle assembly 10. The indicator 16 can also provide an indicator for a circuit breaker within the receptacle assembly.

The receptacle assembly 10 can include a variety of outlets, depending upon the nature of the use of the receptacle. In one embodiment, the front face 20 of the upper housing 12 includes a pair of AC electrical sockets 21 (FIG. 3), and a pair of telephone or data sockets 22. The data sockets can be supported on a mounting plate 23 that is mounted within the structure of the upper housing 12. In the preferred embodiment, the wires connected to the telephone/data sockets extend outward from the upper housing. The mounting plate is removably mounted within a perimetrical groove 24 defined in the upper housing so that the plate 23 can be removed. The plate can be configured to support a variety and number of different sockets, or even printer or networking cables. The phone/data sockets 22 can also be replaced by additional AC electrical sockets like sockets 21. The upper housing 12 includes a release tab 18 on its back face 19 that engages the bezel 11 to hold the upper housing 12 in its retracted position.

Figure 3:
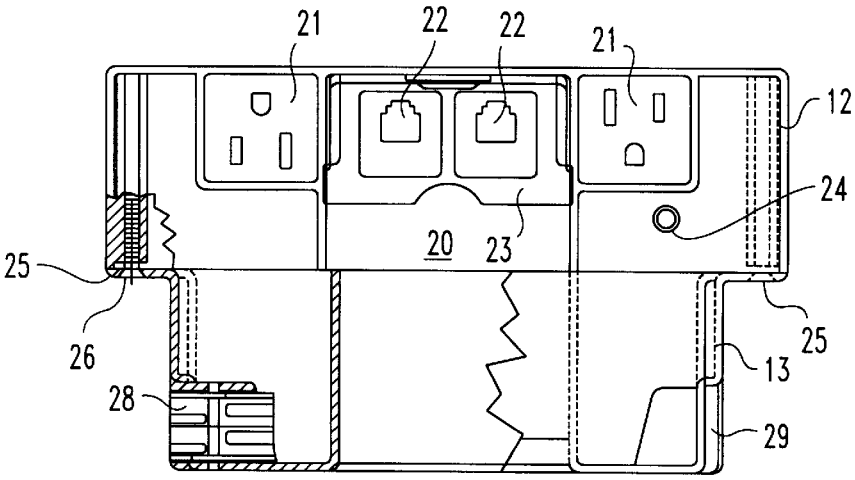
FIG. 3 is a side partial cross sectional view of the extendable electrical receptacle in accordance with the present invention, specifically showing the upper housing and lower housing components of the receptacle.

Referring to FIG. 3, the third component of the extendable receptacle assembly 10 is a lower housing 13. The lower housing 13 is attached to the upper housing 12 by at least a pair of screws 26 extending through a mounting flange 25 of the lower housing 13. The lower housing 13 provides the interface to the electrical power source, and in certain embodiments to a phone/data source. Consequently, the lower housing 13 includes a pair of terminal openings 28 and 29. The terminal openings can be configured to accept a variety of electrical connections, depending upon the nature of the signal, whether AC power or data, being provided to the extendable receptacle assembly 10. Again, in the illustrated embodiment, the terminal openings are provided for an AC electrical power interface.

Figure 4:
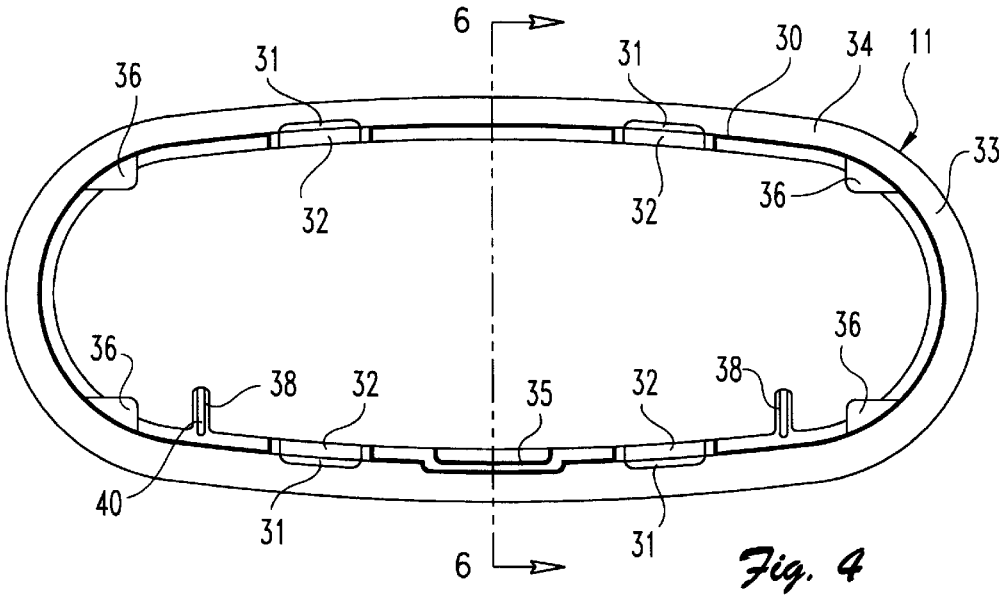
FIG. 4 is a bottom elevational view of the extendable electrical receptacle shown in FIG. 2.
Figure 5:
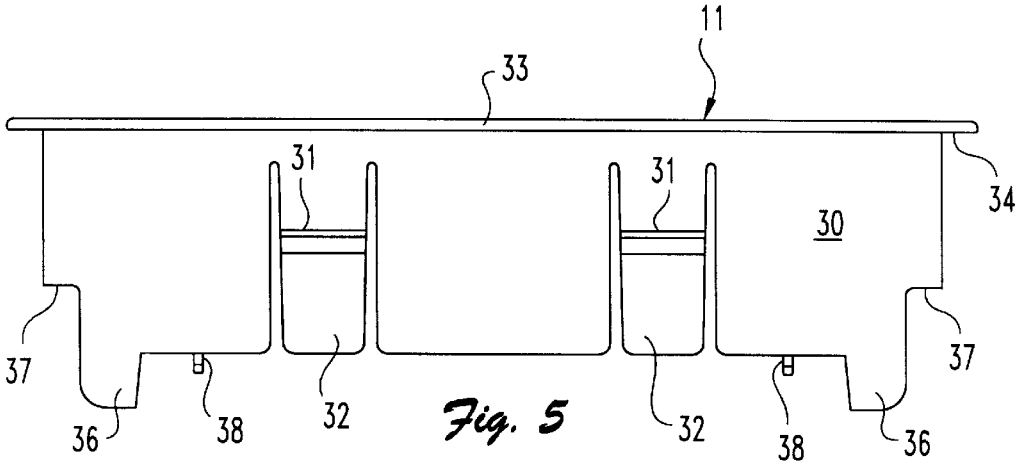
FIG. 5 is a side elevational view of the bezel portion of the extendable electrical receptacle shown in FIG. 2.
Figure 6:
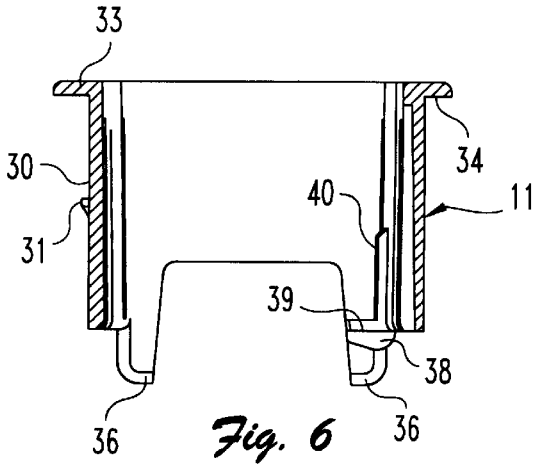
FIG. 6 is a side cross sectional view of the bezel shown in FIG. 4, taken along line 6—6 as viewed in the direction of the arrows.

Details of the first component of the extendable receptacle assembly 10, namely the bezel 11, can be seen with reference to FIGS. 4–6. The bezel 11 includes an annular wall 30 that projects below the surface of the table T when the bezel is in its installed position. The annular wall 30 includes a number of locking tabs 31 that are configured to engage the underside of the table T. In the preferred embodiment, four such tabs 31 are provided on four depressible fingers 32.

In accordance with the present invention, the bezel 11 is simply pushed into a correspondingly sized opening formed in the work surface S of the table T. When the annular wall 30 of the bezel 11 is pushed through the table opening, the tabletop depresses the fingers 32 as the locking tabs 31 pass through the opening. Once the locking tabs reach the underside of the table, the depressible fingers 32 resiliently pivot outward so that the locking tabs 31 engage the underside of the table, thereby locking the bezel 11 in place. Removal of the bezel 11 can be readily accomplished by depressing the fingers 32, thereby releasing the locking tabs 31 from the underside of the table.

As the bezel 11 is pushed into the opening of the table surface S, the bezel contacts the table surface S at the facing flange 33, and more specifically at the table mounting surface 34 on the underside of the flange 33. As discussed above, preferably, the facing flange 33 is rounded to provide a smooth transition between the table surface S and the top plate 15 of the upper housing 12. Also preferably, the facing flange 33 is relatively thin so as to provide as uniform surface as possible with respect to the surface S of the table T.

The bezel 11 includes a housing catch channel 35, as seen in the bottom view shown in FIG. 4. The housing catch channel 35 cooperates with the release tab 18 on the upper housing 12 to hold the extendable receptacle in its stowed or retracted position.

In a further important feature of the present invention, the bezel 11 includes a number of support tabs 36 formed at the bottom of the bezel. Preferably, four such tabs 36 are provided at the rounded corners of the bezel. The tabs 36 project inwardly from the annular wall 30 of the bezel 11 and preferably define a generally flat surface facing upward into the assembly. These support tabs 36 prevent over retraction or excessive depression of the extendable receptacle, in a manner described herein.

In yet another important feature of the invention, the bezel 11 includes a pair of spring supports 38 that are formed at the bottom of the annular wall 30. In the preferred embodiment, two such supports are provided on one side of the bezel 11, specifically on the side opposite the front face 20 of the upper housing 12. The spring supports 38 define an upwardly facing support surface 39, as shown most clearly in FIG. 6. In one modified embodiment, the spring supports 38 are integral with a guide bar 40 that extends part way up the interior of the annular wall 30; however, the guide bar is eliminated in the most preferred embodiment of the present invention.

Figure 7:
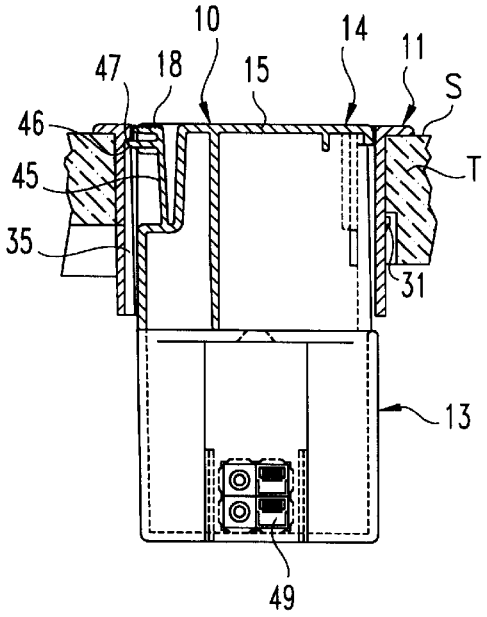
FIG. 7 is a side partial cross sectional view of the extendable electrical receptacle in accordance with the present embodiment with the receptacle shown in its retracted position within a tabletop.

The extendable receptacle assembly 10 is shown in its retracted position in FIG. 7. As shown in this figure, the lower housing 13 is attached to the upper housing 12 in the manner described above. The lower housing 13 is shown with a terminal group 49 engaged within a terminal opening, such as opening 28. As also shown in this figure, the bezel 11 is locked within the table T by way of the locking tabs 31. The release tab 18 of the upper housing 12 includes a tab arm 45 that is resiliently bendable. The tab arm terminates in a latch 46 that rides within the housing catch channel 35. The tab latch 46 contacts the end of the channel to hold the upper housing 12 in its retracted position within the bezel 11. Preferably, the release tab 18 can be provided with a gripping surface 47 to facilitate manual manipulation of the tab arm 45. The release tab 18 can be released by pressing downward and inward on the gripping surface 47, thereby releasing the tab latch 46 from the housing catch channel 35.

Figure 8:
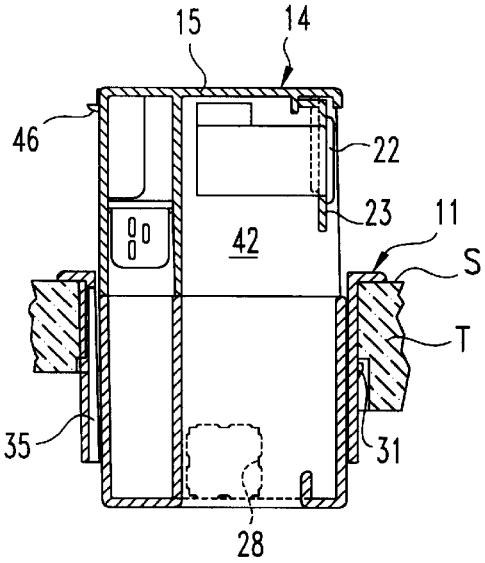
FIG. 8 is a side cross sectional view of the extendable electrical receptacle in which the receptacle is in its extended position.
Figure 9:
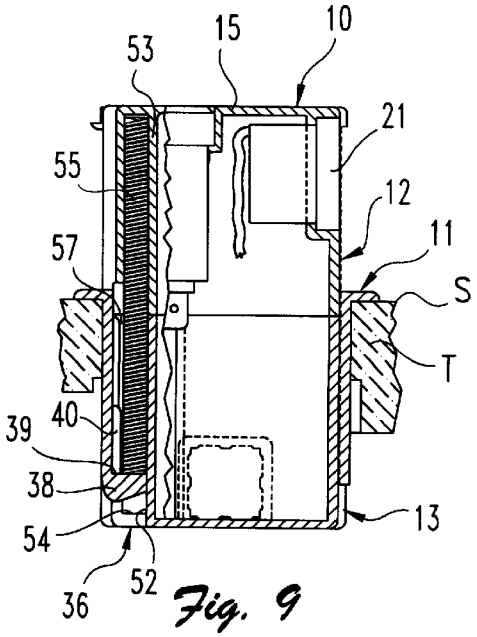
FIG. 9 is a side cross sectional view of the electrical receptacle shown in its extended position, as taken along section 9—9 in FIG. 10 and viewed in the direction of the arrows.
Figure 10:
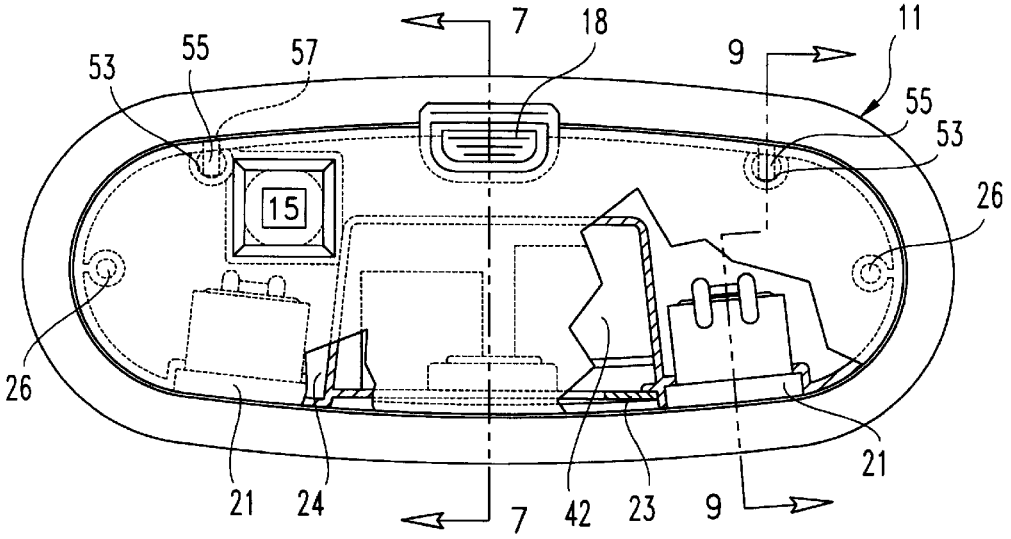
FIG. 10 is a top elevational view of the extendable electrical receptacle with a partial cross section.
Figure 11:
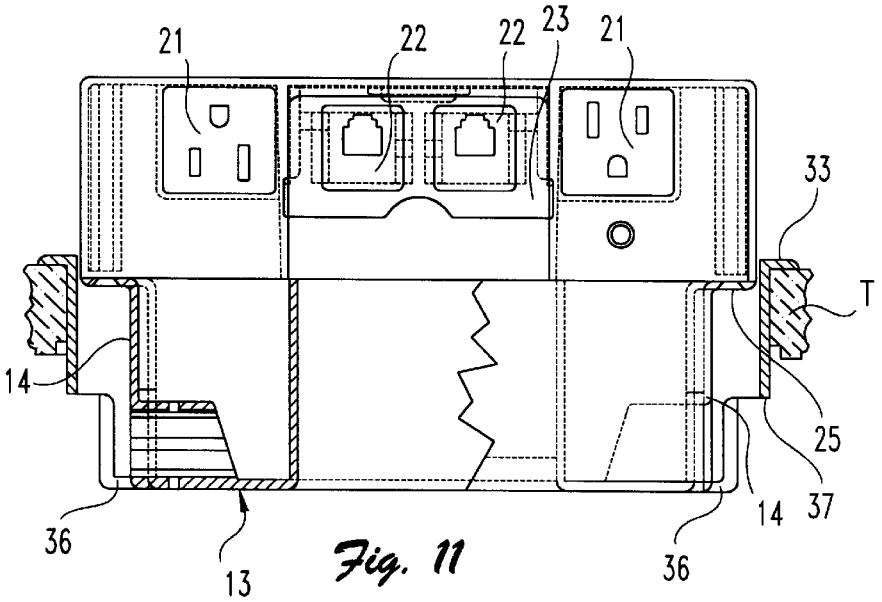
FIG. 11 is a side partial cross sectional view of the extendable electrical receptacle in its extended position mounted in a tabletop.

The extendable electrical receptacle assembly 10 of the present invention is shown in its extended position in FIGS. 8 and 9. In the cross sectional view of FIG. 8, the upper housing 12 is shown to include a data socket cavity 42. The phone/data socket 22 is disposed within this cavity. As can be seen in FIGS. 8 and 10, the cavity provides significant space for containing the various electrical connections between the sockets and the input data cables.

The extension mechanism for the present extendable receptacle assembly 10 is best seen in FIG. 9. In accordance with the preferred embodiment of the invention, the extension mechanism stores potential energy when the receptacle is in its retracted position, and is operable to move the upper and lower housings to the extended position. The mechanism utilizes a lower spring channel 52 defined in the lower housing 13. The upper housing 12 includes an upper spring channel 53 that is collinear and contiguous with the lower spring channel 52. A spring 55 is disposed within both spring channels 52 and 53. In accordance with one aspect of the present invention, the upper spring channel 53 is closed at the upper plate, while the upper spring channel 53 completely surrounds the spring 55—in other words, the channel is in the form of a closed—ended bore. On the other hand, the lower spring channel 52 is more in the form of an open C configuration. This configuration is seen best in FIGS. 10 and 12. Thus, while the lower spring channel 52 substantially surrounds and contains the spring 55, it does provide a slot opening 57 into which the spring support 58 extends. The end of the lower spring channel 52 also defines a pair of opposed ledges 54, best seen in FIG. 12. The compression spring 55 is supported by the ledges so that the spring is completely contained within the mating spring channels 52, 53. The compression spring 55 can be assembled within the upper and lower housings before they are connected together at the mounting flange 25.

The ledges 54 are spaced apart to match the slot opening 57. The spring support 38 slides within the slot 57 and between the ledges of the lower spring channel 52. Thus, the spring support 38, and particularly the support surface 39, supports the spring 55 when it is disposed within the upper spring channel 53 and lower spring channel 52. When the assembled receptacle housing is placed within the bezel, the spring supports 38 are aligned with and enter the slot 57 to contact the spring. When the receptacle housings are pushed fully to lock within the bezel, the bezel spring supports compress the spring 55.

As depicted in FIG. 9, the spring 55 is in its extended position. In this position, the spring 55 has a slightly compressed length that is substantially equal to the distance between the spring support surface 39 and the closed end of the upper spring channel. The spring 55 is configured to be additionally compressed when the upper housing 12 is pushed down into the bezel 11. When the release tab 18 engages the bezel 11 in the fully retracted position, the spring 55 is compressed to a height approximately equal to the distance between the spring support surface 39 and the surface S of the table T. It is of course understood that when the spring 55 is in its compressed condition, potential energy is being stored. Once the release tab 18 is depressed and the upper housing 12 released from the bezel 11, the stored energy of the springs 55 push the upper and lower housings, 12 and 13, upward through the bezel 11 to their extended positions.

In a specific embodiment, the bezel 11 can have an overall length of about 7.25 inches and an overall width of about 3.0 inches spanning the surface S of the table T. The complete assembly of the upper housing 12 and the lower housing 13 has an overall height of about 4.0 inches. In the retracted position, of course, the upper and lower housings are substantially hidden beneath the surface S of the table. The overall height of the upper and lower housings is relatively compact so that even in the retracted position, the extendable receptacle does not project significantly far below the surface of the table, typically on the order of 3.0 inches. The retracted "height" of the receptacle assembly 10 beneath the table T is calibrated to accept usage in a folding table. In a typical folding table, the folded legs will occupy an envelope slightly greater than three inches. Thus, the retracted assembly will not extend outside the envelope defined by the folded table legs. This feature of the invention allows use of the receptacle assembly 10 on both fixed and folding tables.

In a specific embodiment, the extendable receptacle has a stroke of about 1.75 inches between the retracted and the extended positions. In other words, the upper plate 15 of the upper housing 12 will be about 1.75 inches above the surface S of the table when the receptacle is extended. Thus, the spring 55 must be configured to be compressed 1.75 inches, while still retaining enough potential energy in its extended position to support the weight of the receptacle housings. In one specific embodiment, the spring 55 can have an overall free length of about 5.0 inches and a compressed height of 1.4 inches. Most typically, the spring has a fully compressed height of about 1.3 inches so that in use the spring is not completely compressed when the extendable receptacle is in its retracted position. In this way, the amount of potential energy stored within the spring is controlled. Too much potential energy and the extendable receptacle springs out of the bezel 11 too rapidly. Too little potential energy and spring 55 may not have sufficient power to push the receptacle upward.

Figure 12:
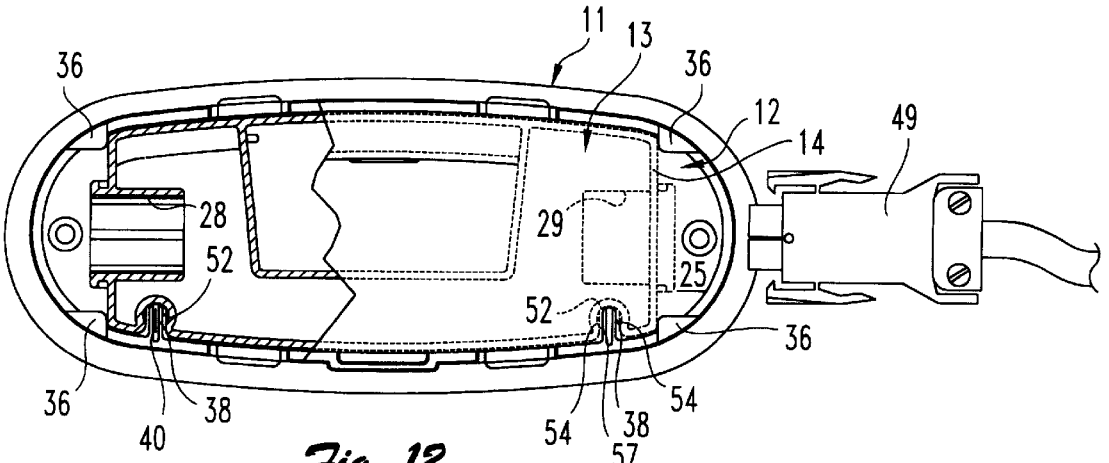
FIG. 12 is a bottom elevational view of the extendable electrical receptacle show in FIG. 11, depicting connection to an electrical terminal group.

With reference to FIG. 12, a further feature of the inventive extendable receptacle is shown. In FIG. 12, the receptacle assembly 10 is viewed from the bottom or underneath the table looking upward. From this view, it can be seen that the lower housing 13 and outer wall 14 slide freely past the four support tabs 36 formed at the bottom of bezel 11. However, the mounting flange 25 of the lower housing 13 has an outer dimension that is substantially equal to the dimension of the interior of the bezel 11. Most specifically, the mounting flange 25 is sized so that the flange 25 will contact the number of support tabs 36 when the upper and lower housings 12, 13 are pushed down into the bezel. Thus, the support tabs 36 provide a stop against over depression of the extendable receptacle assembly 10. As the upper housing 12 is pushed down, its path continues through the bezel 11 until the mounting flange 25 contacts each of the support tabs 36 and the bezel 11 fixed within the table T.

Preferably, however, the support tabs 36 would not be necessary. In the specific embodiment, the support tabs are situated so that they will only be contacted by the mounting flange 25 if the upper housing 12 is pushed below the point at which the release tab 18 latches into the housing catch channel 35 of the bezel 11. The support tabs 36 provide the additional function of protecting the spring supports 38 from the application of excessive force as the extendable receptacle assembly 10 is pushed down. If the support tabs 36 were not present, it would be possible for the receptacle to be pushed well below the surface S of the table until the force transmitted to the springs breaks off the springs support 38 of the bezel 11. The support tabs 36 provide uniform support for the lower housing 13 and protection against pushing the housing too far into the bezel 11.

Figure 13:
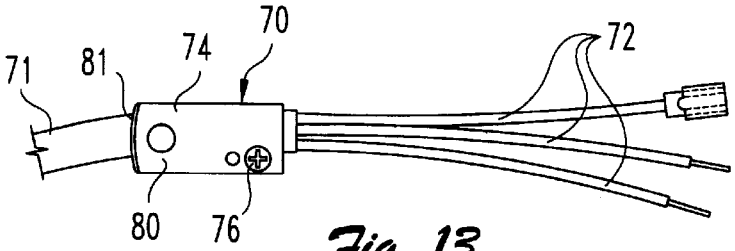
FIG. 13 is a top elevational view of a strain relief component of the present invention.
Figure 14:
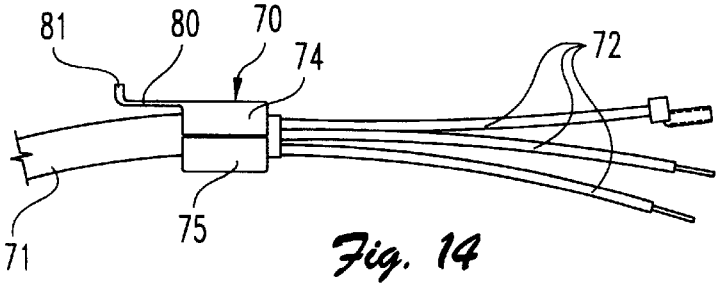
FIG. 14 is a side elevational view of the strain relief component shown in FIG. 13.
Figure 15:
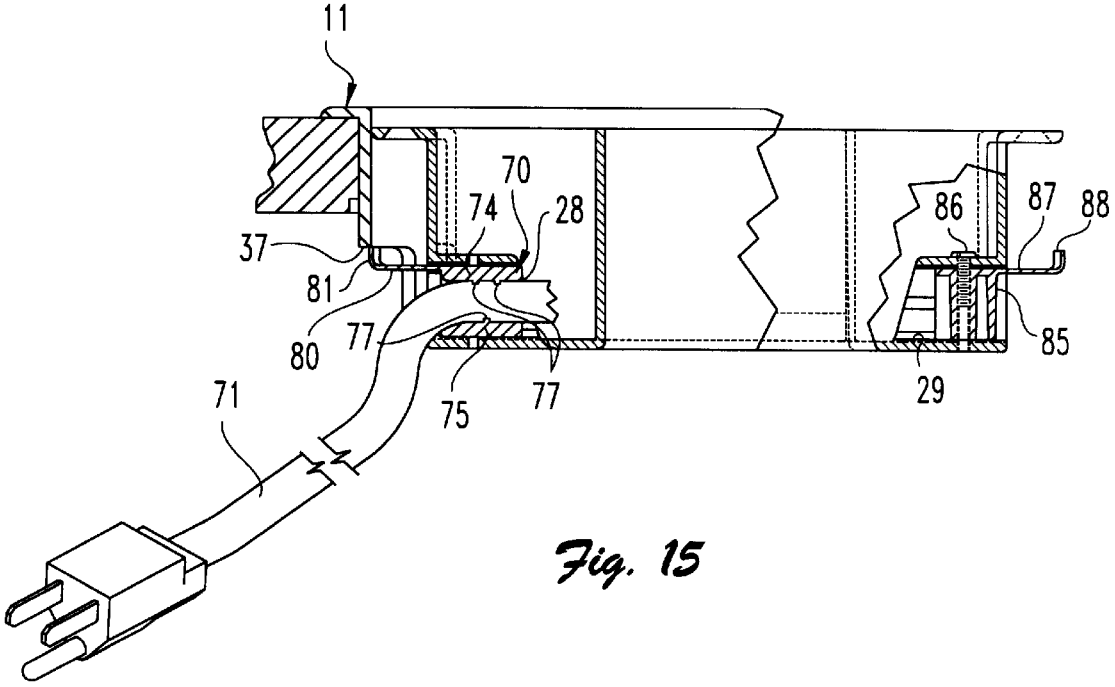
FIG. 15 is a side partial cross sectional view of the lower housing of the extendable electrical receptacle mounted within a table, with the strain relief components as shown in FIGS. 13 and 14.

A further aspect of the present invention is shown in FIGS. 13–15. In accordance with the present invention, a strain relief component 70 is provided. The strain relief 70 is engaged about a cord set 71. In the illustrated embodiment, the cord set 71 may be a power cord that is plugged into an electrical outlet of the building. The cord set terminates within the extendable electrical receptacle in a number of wires 72. As shown in FIG. 13, these wires can include a pair of AC power leads as well as a ground lead. As with any strain relief device, the strain relief component 70 protects the cord set 71 and individual wires 72 in the event that the cord set 71 is inadvertently pulled. Thus, the strain relief component 70 can be slid or pressed into a terminal opening 28 in the lower housing 13.

Preferably, the strain relief component 70 includes an upper body 74 and a lower body 75 that are clamped about the cord set 71. A locking screw 76 can be used to fix the upper and lower bodies 74, 75 together. Gripping nubs 77 project from the interior of the two bodies to clamp and engage the exterior of the cord set 71. Also preferably, the upper and lower bodies are formed of a resilient material that is press fit within one of the terminal openings, such as opening 28. In one embodiment, the press fit can be sufficiently strong to prevent removal of the cord set 71 from the extendable receptacle assembly 10 under normal conditions, but permitting removal if excessive force is applied to the cord set. In an alternative embodiment, the locking screw can provide a sufficiently strong retention force to prevent removal of the cord set from the receptacle assembly under excessive pull forces applied to the cord set.

In the further feature of the strain relief component 70, a flap 80 extends from the upper body 74. The flap 80 terminates in a stop tab 81 that in the preferred embodiment is bent upward relative to the remainder of the strain relief component 70. As shown in FIG. 15, the stop tab 81 contacts the lower rim 37 of the bezel 11 to provide a positive stop against upward movement of the upper and lower housing assembly to the extended position. The flap 80 can be formed of a relatively rigid material so that it will not bend or will bend only slightly under the spring force that is applied to push the upper and lower housing assembly upward out of the bezel 11. Alternatively, the flap 80 can retain some flexibility to allow the flap to be flexed or bent upward and inward toward the lower housing 13. With this movement, the flap can be displaced inside the bezel 11 to clear the lower rim 71. When the flap 80 is flexed inwardly, the upper and lower housings of the receptacle can be pulled out of the bezel.

In another feature, a blank end 85 is provided for the opposite terminal opening 29 in the event that a second cord set is not being utilized. In this component, the blank end 85 is held within the terminal opening 29 by way of a screw 86. Alternatively, the blank end 85 can be configured for a press-fit engagement within the opening 29 in a manner similar to the strain relief component 70. As with the strain relief component 70, the blank end 85 includes a flap 87 and a stop tab 88. Thus, the combination of the strain relief component 70 and the blank end 85 provides a positive stop at the opposite ends of the extendable receptacle to prevent over extension of the upper and lower housing assemblies from the bezel 11.

An alternative to the strain relief component 70 and blank end 85 would be to form an arm on the lower housing 13 that will engage the rim 37 of the bezel 11. However, the use of the strain relief component 70 and blank end 85 greatly facilitates the manufacture of the lower housing 13. Without the necessity of an external flap or stop feature, the lower housing 13 can be easily formed in a die casting or injection molding operation.

Figure 16:
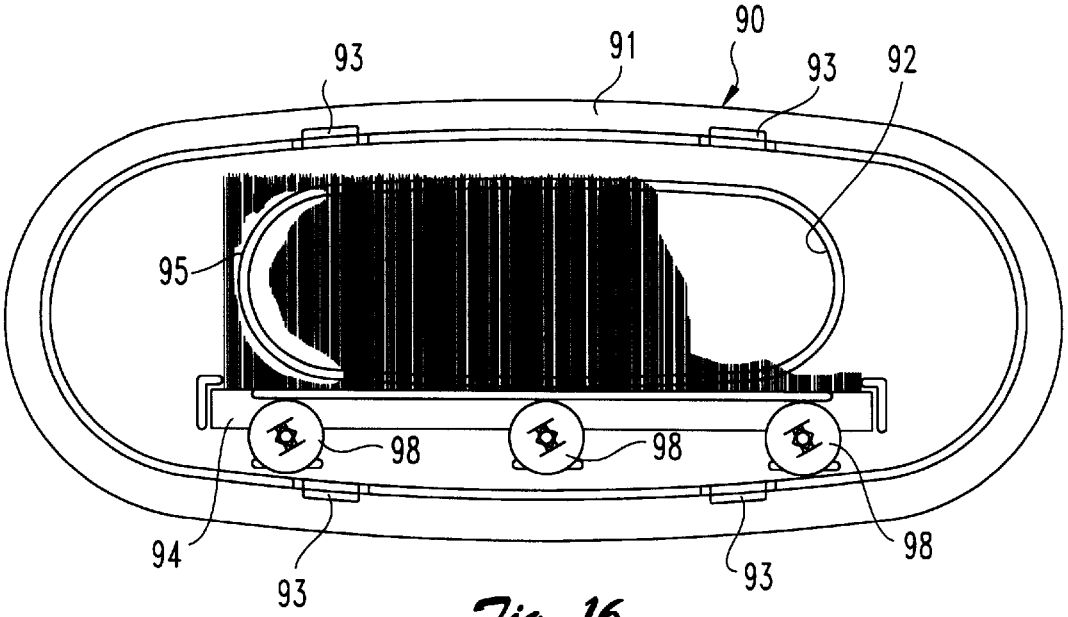
FIG. 16 is a bottom partial cutaway view of a brush plate according to one embodiment of the present invention.
Figure 17:
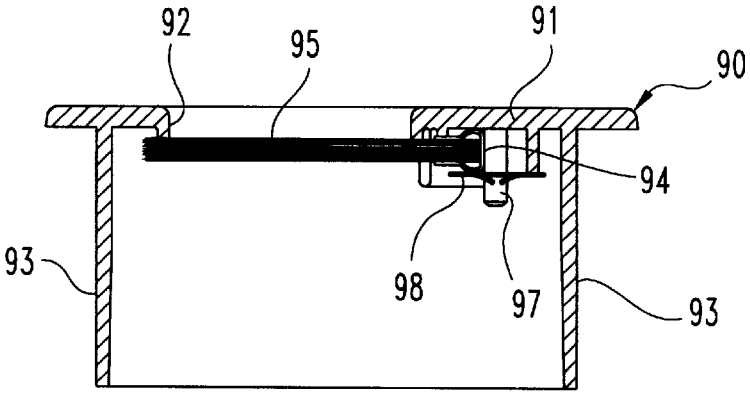
FIG. 17 is a side cross sectional view of the brush plate shown in FIG. 16.

The extendable electrical receptacle assembly 10 of the present invention provides a very compact alternative to the bulky and often complicated devices of the past. The connected upper and lower housings of the receptacle assembly 10 can be readily removed from the bezel 11 disposed in the opening in the table T. The bezel itself can then be easily removed as described above. In this instance, the extendable receptacle assembly 10 can be replaced by a brush plate 90, as shown in FIGS. 16 and 17. In accordance with this embodiment, the brush plate 90 includes a bezel 91 having a central opening 92. In most respects, the bezel 91 is configured similar to the bezel 11. The bezel 91 includes a number of locking tabs 93 that are configured to engage the underside of the table.

The brush plate 90 includes a brush bar 94 having a thick brush 95 that spans and covers the opening 92. The brush 95 includes a multitude of bristles that can be separated to permit the passage of an electrical cord(s) through the opening in the table surface S. The brush bar 94 is held to the bezel 91 by a posts 97 that project from the bezel and fasteners or lock washers 98 that are pressed onto the posts and against the brush bar 94. As can be seen in FIG. 16, three such lock washers 98 can be provided to clamp the brush bar 94 onto the bezel 91.

The components of the extendable electrical receptacle assembly 10 can be easily conformed using well-known molding techniques. Preferably, all of the components of the receptacle are formed of a high impact plastic material. Alternatively, the components can also be formed of metal or include some metal features to achieve a variety of aesthetic effects. In the simplicity of the present invention provides a completely removable extendable receptacle that is easy to use. Moreover, the inventive extendable receptacle incorporates various features to protect the components of the receptacle, while limiting the upper and lower travel of the moveable upper housing 12 and lower housing 13.

While the invention has been illustrated and described in detail in the foregoing drawings and description, the same is to be considered as illustrative and not restrictive in character, it being understood that only preferred embodiments thereof have been shown and described and that all changes and modification that come within the skpirit of the invention are desired to be protected.

What is claimed is:

1. An extendable/retractable temporary electrical receptacle assembly mountable within an opening formed through a work surface of an article of furniture, comprising:

a bezel configured for placement within the opening in the work surface of the article of furniture, said bezel having an upper plate contacting the work surface and an annular wall projecting through the opening and below the work surface, said annular wall terminating in inwardly projecting tabs disposed at a plurality of locations around the lower perimeter of said wall;

a receptacle having a hollow body configured for slidable movement within said annular wall of said bezel, said receptacle including an upper portion having at least one electrical/data socket supported thereon for access above the work surface when said receptacle assembly is in an extended position, and a lower portion defining at least one cord opening for receiving an electrical cord for electrical connection to said at least one socket, said lower portion being sized for slidable movement within said annular wall of said bezel and past said inwardly projecting tabs to a retracted position in which said upper portion is substantially wholly contained within said bezel, said receptacle further including means between said upper portion and said lower portion for engaging said inwardly projecting tabs of said bezel to limit downward movement of said receptacle within said bezel to prevent over retraction of said receptacle wherein said upper portion extends past said lower perimeter of said annular wall; and an extension mechanism operable to store potential energy when said receptacle is in said retracted position and to move said receptacle to said extended position upon release of said potential energy.

2. The receptacle assembly according to claim 1, wherein said bezel includes means for locking said bezel within the surface opening.

3. The receptacle assembly according to claim 2, wherein said means for locking includes at least one deflectable finger defined in said annular wall, said finger including an outwardly projecting locking tab spaced apart from said upper plate of said bezel to engage the underside of the furniture work surface.

4. The receptacle assembly according to claim 3, wherein said bezel includes four deflectable fingers, each having an outwardly projecting tab.

5. The receptacle assembly according to claim 1, wherein said means for engaging includes a flange extending outwardly from said lower portion of said receptacle.

6. The receptacle assembly according to claim 5, wherein:

said flange defines at least one mounting opening therethrough;

said upper portion defines at least one threaded bore therein aligned with said at least one mounting opening when said upper portion is in contact with said lower portion; and at least one screw adapted to extend through said at least one mounting opening in said lower portion and threadedly engage said at least one bore in said upper portion to attach said upper portion to said lower portion.

7. The receptacle assembly according to claim 1, wherein said means for storing potential energy includes at least two springs disposed apart and between said receptacle and said bezel.

8. The receptacle assembly according to claim 7, wherein said receptacle defines at least two spring bores between said upper and lower portions, each of said spring bores configured to substantially enclose a corresponding one of said springs.

9. The receptacle assembly according to claim 1, wherein said means for storing potential energy includes a latch mechanism between said bezel and said receptacle operable to latch said receptacle in said retracted position.

10. The receptacle assembly according to claim 1, wherein:

said annular wall of said bezel defines a lower rim below the work surface; and said receptacle includes a flap projecting outward from said lower portion disposed within said bezel, said flap extending outward a sufficient distance to contact said lower rim of said bezel when said receptacle is in said extended position to thereby limit the upward travel of said receptacle within said bezel.

11. The receptacle assembly according to claim 10, wherein said flap is bendable toward said receptacle and away from engagement with said lower rim of said bezel to permit removal of said receptacle from said bezel.

12. The receptacle assembly according to claim 10, wherein said flap is connected to a strain relief member, said strain relief member engageable about the electrical cord and sized for engagement within said at least one cord opening.

13. An extendable/retractable temporary electrical receptacle assembly mountable within an opening formed through a work surface of an article of furniture, comprising:

a bezel configured for placement within the opening in the surface of the article of furniture, said bezel having an upper plate contacting the work surface and an annular wall projecting through the opening and below the work surface, said bezel including at least two inwardly projecting tabs disposed apart at the lower perimeter of said wall;

a receptacle having a hollow body configured for slidable movement within said annular wall of said bezel, said receptacle including an upper portion having at least one electrical/data socket supported thereon for access above the work surface when said receptacle assembly is in an extended position, and a lower portion defining at least one cord opening for receiving an electrical cord for electrical connection to said at least one socket, said lower portion being sized for slidable movement within said annular wall of said bezel, said receptacle further defining at least two spring channels between said upper portion and said lower portion aligned with said at least two inwardly projecting tabs, each of said spring channels being at least partially closed at one end in said upper portion and at an opposite end in said lower portion; and at least two springs each disposed within a respective one of said spring channels between said one end and a corresponding one of said inwardly projecting tabs, each of said springs operable to store potential energy when compressed between said one end and said inwardly projecting tab when said receptacle is in said retracted position and to push said receptacle away from said inwardly projecting tabs to said extended position upon release of said potential energy.

14. The receptacle assembly according to claim 13, wherein:

each of said spring channels includes;

a spring bore defined in said upper portion that completely encircles a corresponding one of said springs disposed within said spring channels; and a spring bore defined in said lower portion that defines a slot therein; and each of said inwardly projecting tabs is configured to extend through said slot of a corresponding spring channel in said lower portion and to project into said corresponding spring channel, whereby, said lower portion of said receptacle rides along said inwardly projecting tabs with a corresponding one of said springs disposed within said spring channel in contact with a corresponding inwardly projecting tab.

15. An extendable/retractable temporary electrical receptacle assembly mountable within an opening formed through a work surface of an article of furniture, comprising:

a bezel configured for placement within the opening in the surface of the article of furniture, said bezel having an upper plate contacting the work surface and an annular wall projecting through the opening and below the work surface, said annular wall defining a lower rim below the work surface;

a receptacle having a hollow body configured for slidable movement within said annular wall of said bezel, said receptacle including an upper portion having at least one electrical/data socket supported thereon for access above the work surface when said receptacle assembly is in an extended position, and a lower portion defining at least one cord opening for receiving an electrical cord for electrical connection to said at least one socket, said receptacle being sized for slidable movement within said annular wall of said bezel between a retracted position in which said receptacle is wholly contained within said bezel and an extended position in which at least said electrical/data socket is disposed above the work surface; and a strain relief member engageable about the electrical cord and sized for press-fit engagement within said at least one cord opening, said strain relief member including a flap projecting outward from said lower portion when said member is engaged within said cord opening, said flap extending outward a sufficient distance to contact said lower rim of said bezel when said receptacle is in said extended position to thereby limit the upward travel of said receptacle within said bezel.

16. The receptacle assembly according to claim 15, wherein said flap of said strain relief member includes an upturned tab arranged to contact said lower rim of said bezel.

17. The receptacle assembly according to claim 15, wherein said flap is bendable toward said receptacle and away from engagement with said lower rim of said bezel to permit removal of said receptacle from said bezel.

18. The receptacle assembly according to claim 15, wherein: said lower portion of said receptacle body defines a second cord opening; and said assembly includes a blank end configured to be engaged within said second cord opening, said blank end including a flap projecting outward from said lower portion when said blank end is engaged within said second cord opening, said flap extending a sufficient distance to contact said lower rim of said bezel when said receptacle is in said extended position.

* * * * *